US007204038B2

(12) United States Patent
Santhouse

(10) Patent No.: US 7,204,038 B2
(45) Date of Patent: Apr. 17, 2007

(54) HAIRDRYER WITH ELECTROSTATIC PRECIPITATOR AND FILTER CLEANOUT WARNING

(75) Inventor: Daniel Santhouse, Wilton, CT (US)

(73) Assignee: Conair Corporation

( * ) Notice: Subject to any disclaimer, the term of this patent is extended or adjusted under 35 U.S.C. 154(b) by 24 days.

(21) Appl. No.: 11/083,430

(22) Filed: Mar. 18, 2005

(65) Prior Publication Data

US 2005/0204577 A1 Sep. 22, 2005

Related U.S. Application Data

(60) Provisional application No. 60/554,265, filed on Mar. 18, 2004.

(51) Int. Cl.
*A45D 20/12* (2006.01)

(52) U.S. Cl. ..... 34/97; 392/384; 361/213; 132/116

(58) Field of Classification Search ..... 34/96–100; 132/116, 154; 392/380, 384; 361/212, 213
See application file for complete search history.

(56) References Cited

U.S. PATENT DOCUMENTS 5,215,558 A * 6/1993 Moon ..... 96/62
6,176,977 B1 * 1/2001 Taylor et al. ..... 204/176
6,635,153 B1 * 10/2003 Whitehead ..... 204/176

* cited by examiner

*Primary Examiner*—S. Gravini
(74) *Attorney, Agent, or Firm*—Lawrence Cruz; Steven A. Garner

(57) ABSTRACT

A hairdryer air intake is cleansed of dust particles with an electrostatic precipitator. The precipitator consists of a charging device (1) and a grounded filter media (2) that can be removed and cleaned. A warning lamp (13) indicates the need to clean the filter.

8 Claims, 5 Drawing Sheets

HAIRDRYER WITH ELECTROSTATIC PRECIPITATOR AND FILTER CLEANOUT WARNING

RELATED APPLICATIONS

This application is related to and claims priority from U.S. Provisional application 60/554,265 (filed 18 Mar. 2004).

TECHNICAL FIELD OF THE INVENTION

The present invention relates hairdryers and, more particularly, to an improved hairdryer in which the air intake is cleansed of dust particles with an electrostatic precipitator.

BACKGROUND OF THE INVENTION

It is known in the art to filter intake air into a hair dryer in order to cleanse the air, which is to be blown upon the head and face. Prior art filters have employed various direct filter medias of various densities. However, the coarse filters remove little dust and the fine filters interfere significantly with the airflow. A clogged filter can result in hairdryers that quickly overheat and, as a result, can cycle on and off during normal use.

It is known in the art to utilize electronic precipitators to cleanse air in room air cleaners by charging airborne dust particles and then collecting these charged particles in a grounded filter medium.

OBJECTS AND SUMMARY OF THE INVENTION

It is an object of the present invention to provide a hairdryer that overcomes the shortcomings of known hair dryers mentioned above. These and other objects are achieved by the present invention described herein.

The present invention avoids the problem of passive porous filters used in a hair dryer intake by employing an electronic precipitator to more efficiently remove air contaminants such as dust, smoke and pollen particles. The active filtration allows more efficient removal of airborne particles while reducing the resistance to the airflow.

A charged screen can be employed at the air intake to ionize air upstream of a grounded, porous media, with a potential between the screen and media of at least 3 to 10 KV. The collection media can made of a number of alternative porous and conductive materials, such as a carbon-loaded plastic foam, metallized glass fiber or metallic foam. The electrical activation of the downstream media allows a much coarser filter pore to be used than in a passive media. Alternatively an array of metal plates or an expanded metal or woven screen can also be used as a dust collector. Dust collecting media or plates can be designed for easy removal for cleansing.

An assembly of porous, dielectric foam sandwiched closely between opposing electrode screens can be used as the charging device and as a removable collecting cartridge. The proximity of the opposing electrical fields to the insulating filter media results in the dielectric material actively and efficiently collecting dust.

Alternatively, a grounded media or collection screens can be used downstream of a high Voltage, ionizing point source or a similar array of point sources. With these or similar ionizing and collection structures, intake air to a hairdryer can be efficiently cleaned with considerably less resistance to the airflow through the dryer.

The precipitator device can be designed to be switched on or off, and the device can also be switched selectively through various voltage levels to increase or decrease the amount of ionization and the filtering efficiency of the aircleaner. The insulation and electrode architecture is designed to avoid visible arcs or sparkovers.

The high voltage generation can be accomplished with a number of well-known electronic circuits. Coil windings and piezo crystals can generate sufficient voltage. The high voltage generator can be housed within the dryer body, within the handle of the dryer, inside the filter structure, pendant on the dryer supply cord, or at the wall plug. The generator and leads to the precipitator can be wired into the dryer or they can be designed with the generator and power supply cord independent of the hairdryer so that the active filter can be sold as an optional add on to a conventional hairdryer.

In addition, when the filter media does eventually become clogged with dust particles, the increased resistance will reduce the air intake. When the air volume is significantly reduced the dryer temperatures will climb. It is common to employ a "split circuit" in hairdryers, which switches out a large portion of the heater on a thermostat, while maintaining the dropping circuit to the motor. The present invention employs a neon light wired across the temperature-limiting thermostat of the split circuit, so that when the thermostat opens, the neon will see an increased current, sufficient to light, thereby indicating the need to clean the filter.

BRIEF DESCRIPTION OF THE DRAWINGS

The present invention is more fully understood by reference to the following detailed description of an illustrative embodiment with the drawings identified below.

DETAILED DESCRIPTION OF THE INVENTION

Figure 1:
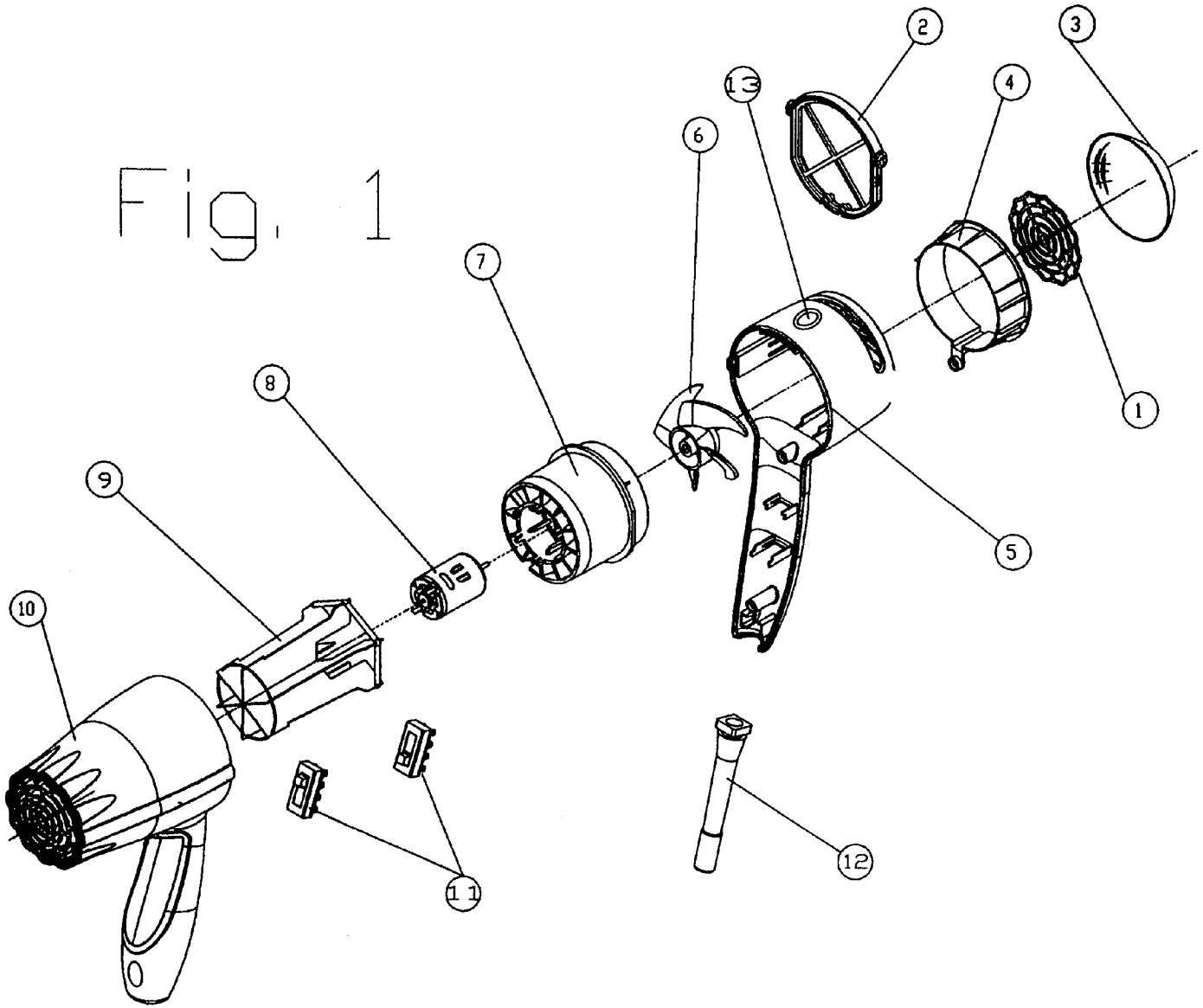
FIG. 1 is an exploded view of the preferred embodiment of a hairdryer with and electronic precipitator on the air intake.

Referring to FIG. 1, the preferred embodiment of the present invention an improved hair dryer employing an electronic precipitator, is illustrated in an exploded schematic view. The device overall is made up of a handle and barrel housing (10), a removable filter assembly (2), a precipitator housing (4), a charging screen (1), a protective rear screen (3), a rear hairdryer housing (5), a fan (6), a motor mount (7), a motor (8), a heater assembly (9), a supply cord and strain relief (12), switches (11) and an indicator light (13).

Figure 2:
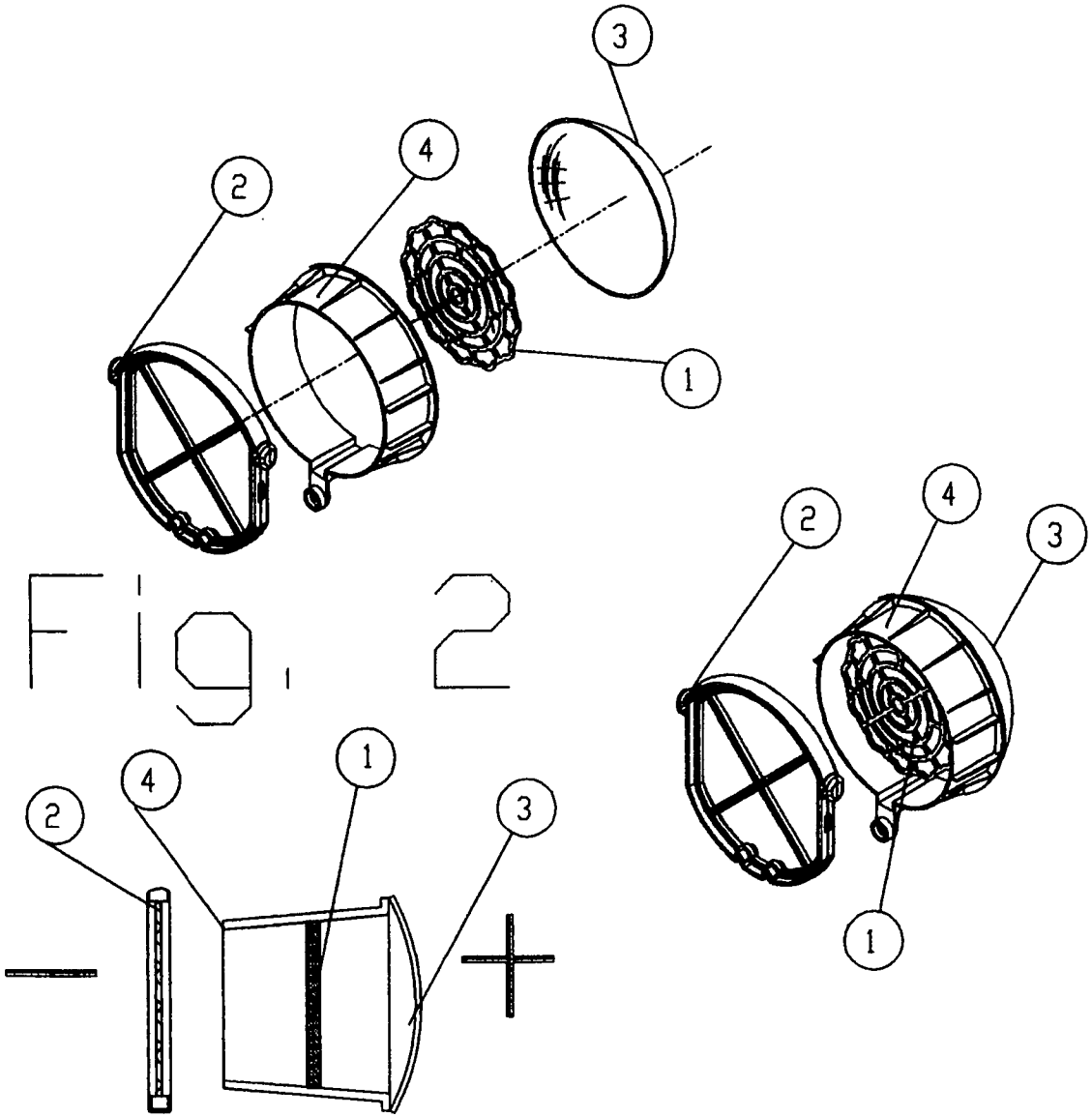
FIG. 2 is a schematic illustration, as well as a cross section, of the preferred embodiment of the electronic precipitator assembly.

FIG. 2 is a closer view of the exploded precipitator assembly as well as a schematic view of the assembled assembly. Also shown in Figure two is a cross sectional view of the assembly. The assembly is made up of a protective cover (3), a precipitator housing (4), a charging screen (1) and a grounded filter (2).

Figure 3:
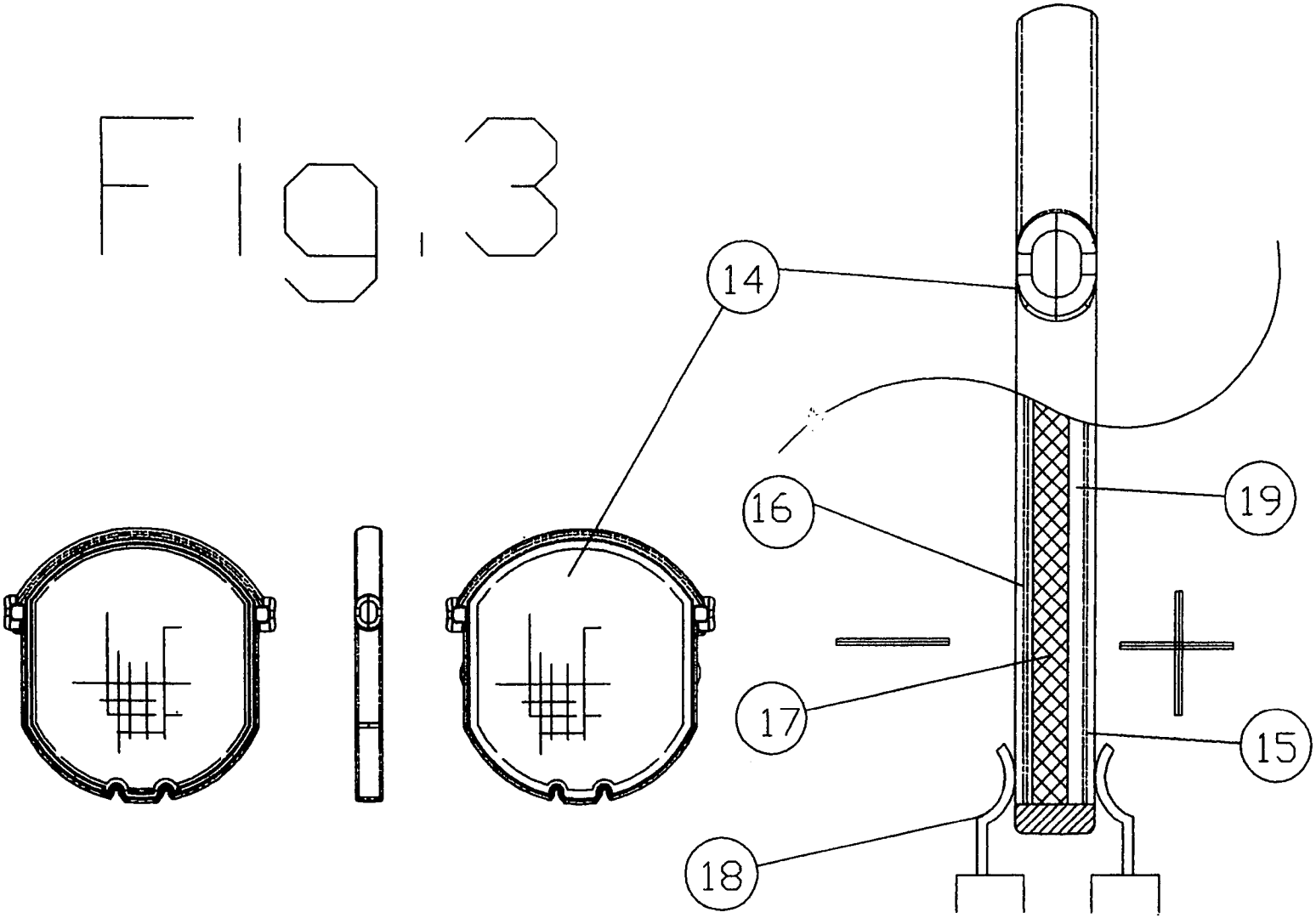
FIG. 3 is an orthographic illustration and a partial section of an alternative electronic precipitator filter assembly.

FIG. 3 shows an orthographic drawing of an alternative assembly of a removable filter (14) and a partial cross section of such a filter. The alternative construction employs a sandwich of charged metallic screens, a high voltage screen (15) and a grounded screen (16). Between the two charged screens is a pad of a porous, dielectric filter material (17) and an air gap (19). The screens mount and make electrical contact inside the hairdryer between two spring contacts (18).

Figure 4:
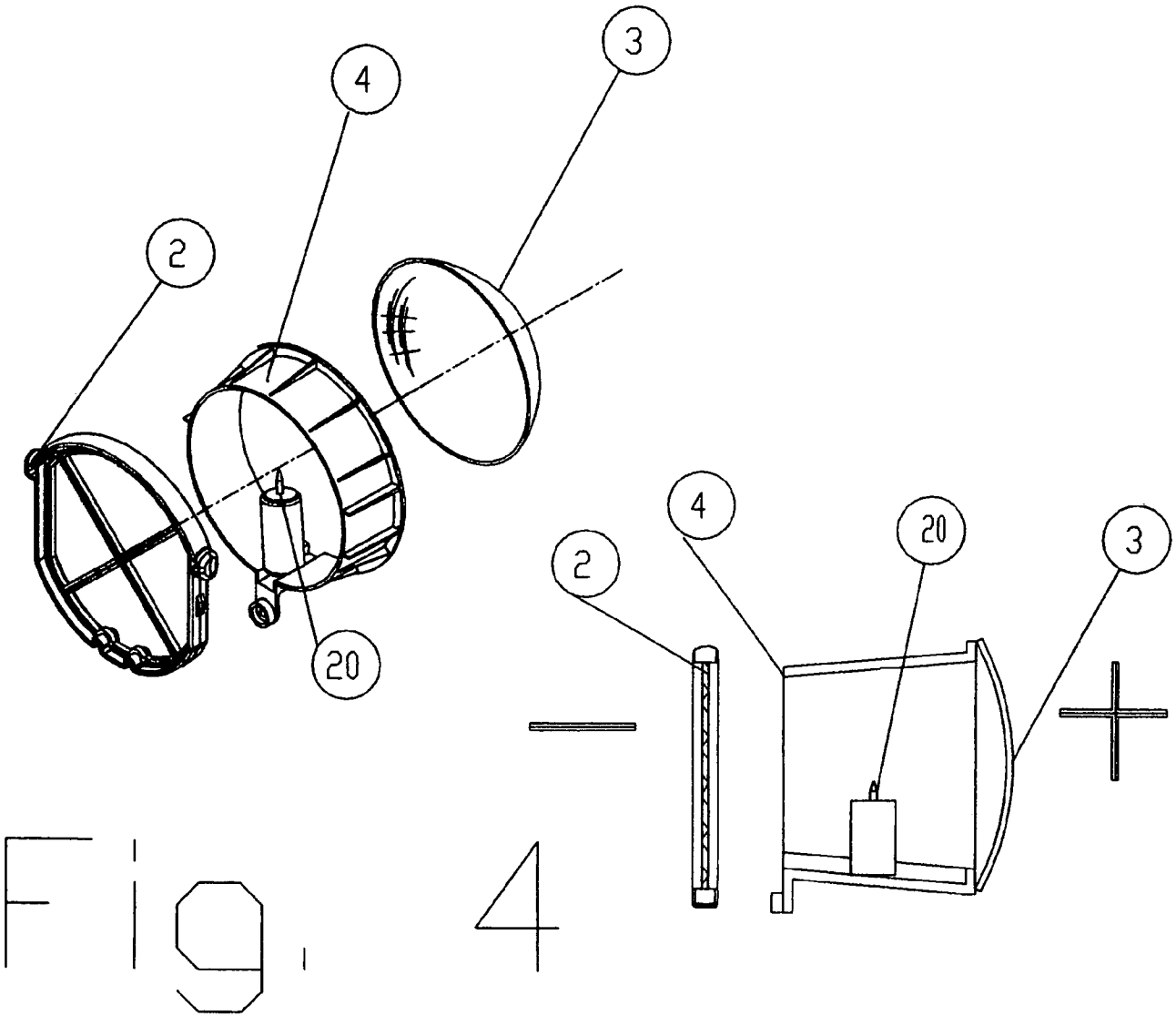
FIG. 4. is an orthographic illustration and a partial section of a second alternative electronic precipitator filter assembly.

FIG. 4 illustrates an additional alternative embodiment of an electronic precipitator employed on the intake of a hairdryer. In this alternative the ionization and charging of the intake air is accomplished with a corona discharge off a highly tensioned needlepoint (20) which is located upstream of a grounded filter (2).

Figure 5:
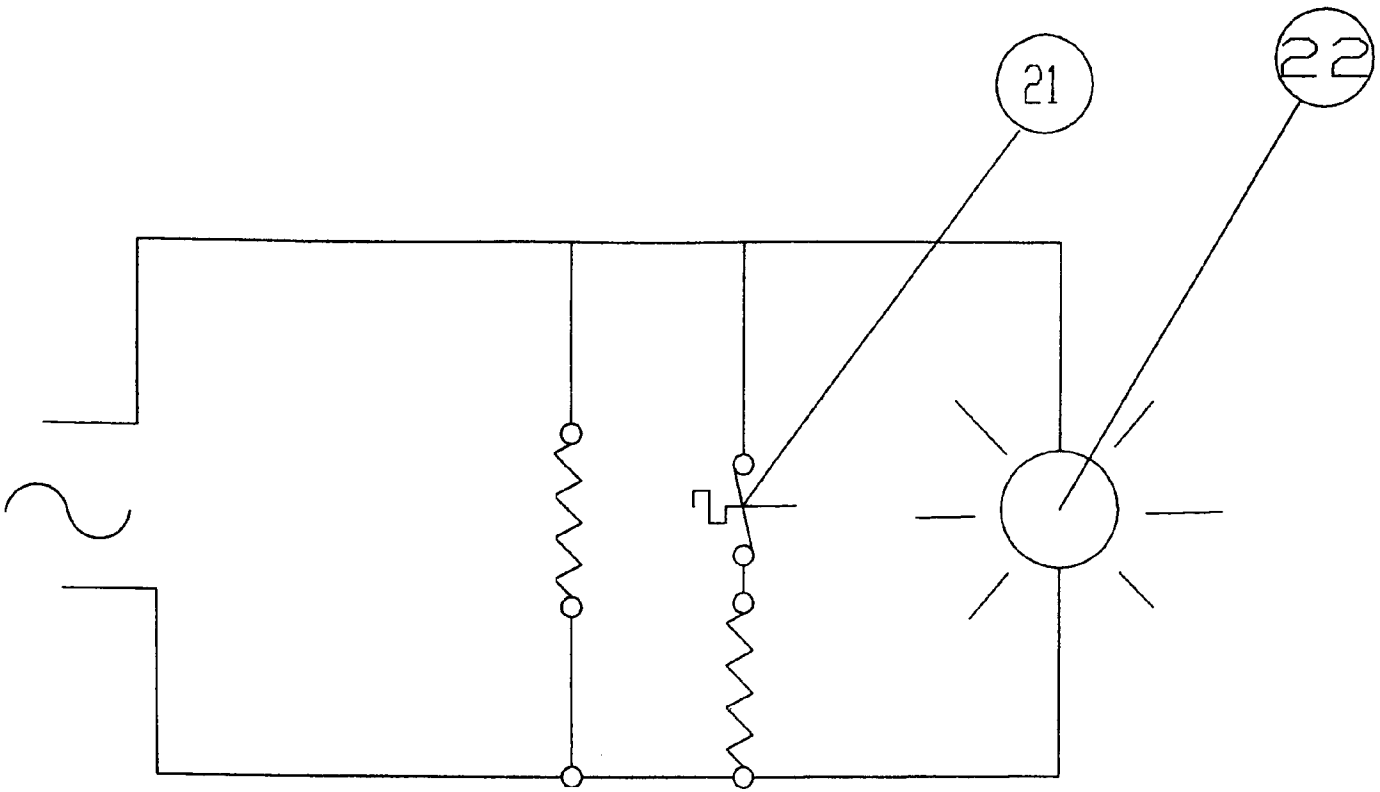
FIG. 5 is a circuit diagram illustrating a neon lamp used as a warning indicator for a clogged air intake filter.

FIG. 5 is an illustration depicting a circuit diagram for the preferred embodiment of the improved hairdryer that illustrates how a neon lamp (22) can be switched around a temperature limiting thermostat to indicate that the normally closed thermostat (21) is open. The thermostat will generally open due to overheating of the hairdryer as a result of a dirty intake filter. The lamp thus operates as a filter cleaning indicator and warning. Such a warning light will also, in addition, indicate other, generally significant problems, if cleaning the filter fails to eliminate the warning light. Such a warning light can be used with an electronic precipitator or alternatively with a passive filter system.

While a preferred embodiment of the invention has been herein disclosed and described, it is understood that various modifications can be made without departing from the scope of the invention.

What is claimed is:

1. A handheld hair dryer appliance comprising:

a housing adapted to be held in a user's hand having an inlet and an outlet;

a fan within said housing;

a heater within said housing for heating air passing from said inlet to said outlet; and a dust-collecting assembly, said dust-collecting assembly further comprising an electrically charged element positioned within an airflow path of said appliance and adapted to electrically charge dust particles in said airflow path; and a grounded element positioned downstream of said charged element in said airflow path and adapted to attract and retain said dust particles after they have been charged.

2. An assembly according to claim 1, wherein said grounded element comprises a removable component for emptying said retained dust particles.

3. An assembly according to claim 1, wherein said charged element is a screen made of an electrically conductive material.

4. An assembly according to claim 1, wherein said grounded element includes a component comprising one or more materials selected from one or more of: carbon-loaded plastic foam, metallized glass fiber, or metallic foam.

5. An assembly according to claim 4, wherein said grounded element comprises a metallic screen.

6. An assembly according to claim 1, further comprising an indicator that indicates when said grounded element has accumulated a predetermined amount of dust particles.

7. An assembly according to claim 6, wherein said indicator is a visual indicator.

8. A handheld hair dryer appliance comprising:

a housing adapted to be held in a user's hand having an inlet and an outlet;

a fan within said housing;

a heater within said housing for heating air passing from said inlet to said outlet; and a dust-collecting assembly, said dust-collecting assembly further comprising one or more electrically charged needle points positioned within an airflow path of said appliance adapted to electrically charge dust particles in said airflow path; and a grounded element positioned downstream of said charged element in said airflow path and adapted to attract and retain said dust particles after they have been charged.

* * * * *